United States Patent [19]

Simeth

[11] Patent Number: 4,864,929

[45] Date of Patent: Sep. 12, 1989

[54] RESILIENT SHEET GRIPPER FOR A SHEET-FED ROTARY PRINTING PRESS

[75] Inventor: Claus Simeth, Offenbach/Main, Fed. Rep. of Germany

[73] Assignee: M.A.N.-Roland Druckmaschinen, Offenbach am Main, Fed. Rep. of Germany

[21] Appl. No.: 213,438

[22] Filed: Jun. 27, 1988

Related U.S. Application Data

[63] Continuation of Ser. No. 892,150, Jul. 31, 1986, abandoned.

[30] Foreign Application Priority Data

Aug. 19, 1985 [DE] Fed. Rep. of Germany ..... 3529656

[51] Int. Cl.[4] ..... B41F 21/04; B41F 1/30

[52] U.S. Cl. ..... 101/246; 101/409

[58] Field of Search ..... 101/409, 410, 411, 412, 101/415.1, 246

[56] References Cited

U.S. PATENT DOCUMENTS

| | | | |
|---|---|---|---|
| 3,650,211 | 3/1972 | Nentwich | 101/409 |
| 3,937,642 | 2/1976 | Kronseda et al. | 101/409 X |
| 4,372,209 | 2/1983 | Jentzsch et al. | 101/409 |
| 4,402,266 | 9/1983 | Sugiyama | 101/409 |

FOREIGN PATENT DOCUMENTS

| | | | |
|---|---|---|---|
| 2836087 | 3/1979 | Fed. Rep. of Germany | 101/409 |
| 1413151 | 8/1980 | German Democratic Rep. | 101/409 |
| 310177 | 4/1929 | United Kingdom | 101/409 |

*Primary Examiner*—Charles Pearson

*Attorney, Agent, or Firm*—Leydig, Voit & Mayer

[57] ABSTRACT

A resilient sheet gripper for a sheet-fed rotary printing press having a gripper shaft to which is secured a pivoting clamping member in resilient relationship with a pivotable gripper finger having a fulcrum and adjsutable biasing, is provided including a base member mounted loosely around the gripper shaft, a joint on the base member for pivotally securing the finger to the base member, a plurality of compression springs disposed on opposite sides of the gripper shaft with associated stops for adjustably pressing the gripper finger and the base member against the clamping member, and another stop which acts against the cylinder upon closure of the gripper finger thereby moving the fulcrum of the gripper finger from the gripper shaft to the joint so as to change the gripper finger lever transmission which then increases the retaining force.

6 Claims, 1 Drawing Sheet

RESILIENT SHEET GRIPPER FOR A SHEET-FED ROTARY PRINTING PRESS

This application is a continuation of application Ser. No. 892,150 filed July 31, 1988 now abandoned.

FIELD OF THE INVENTION

The present invention relates generally to a sheet gripper for a sheet-fed rotary printing press and more particularly concerns such a gripper having a resilient gripper finger.

BACKGROUND OF THE INVENTION

Resilient sheet grippers are widely used in printing presses to non-positively grip a sheet of paper and hold it up against a cylinder. If the paper is pulled out of the gripper even slightly, problems arise with mackling and registration errors occur. Therefore, the gripper typically is required to have a very considerable retaining force, which usually means that the gripper springs must have a very high spring constant. Also, since any play present at the gripper tip would result in registration errors and mackling, it is desirable to minimize the bearing clearances of the gripper elements. The reduced bearing clearance, however, leads to increased friction in the gripper bearings so that some of the spring force operative for gripping is consumed in the bearing itself. The need further arises for the gripper shaft bearings to be very stable in order to reduce deformation associated with the abrupt closure of the grippers. A disadvantage of this is that very high mass forces are produced.

In short, the known gripper systems require very considerable forces for their actuation and only some of such forces can be used for sheet retention. Such substantial and abrupt forces may also cause unwanted oscillations of the press.

A gripper system of this general kind is shown in DD-PS 66 634 wherein a one-piece gripper lever is supported on a gripper shaft and adjustable biasing is provided by two compression springs. A disadvantage of this known system is that the gripper lever loses its statically determined position when the fullest possible compensation for the bearing force is required. At very high press speeds and high biasing forces, centering becomes inadequate, for example, as a result of disturbing vibrations introduced into the press. Other disadvantages are the relatively large inertia radius and the mass of the swinging parts.

The gripper disclosed in DD-PS 67 992 is mounted by means of a clamping member on a pivotable gripper shaft having a stationary axis. A gripper tongue makes a circular movement around such axis in a first movement phase and makes a movement substantially perpendicular to the gripper support in a second movement phase. This gripper, however, uses a nonpositive parallel spring strip arrangement and a gripper tongue which cannot withstand substantial closing forces without buckling. The gripper is therefore completely unsuitable for use with very high closing forces.

Gripper systems of the type disclosed in DE-PS 2 030 040 utilize a perpendicularly closing gripper with a controlled gripper shaft. A disadvantage of this known system is that the nonpositive actuation of the gripper shaft relative to the fulcrum of an actuating lever is by means of a guide on a control cam. The additional components associated with the control cam lead to increased mass forces of the system. The components also oscillate with substantial radii of inertia, leading to a reduction in press performance. Also, if dirt accumulation on the cam is fairly heavy, accurate guidance of the gripper movement phases is impossible.

The gripper system shown in DE-OS 3 130 689 uses a soft gripper support along with a gripper finger which has a flat gripper flight path and which closes perpendicularly in the final movement phase. There is a resilient abutment screw disposed in the gripper finger and operative against the sheet gripper stop. A further adjusting screw is needed to adjust the resiliently interconnected holders by which the gripper finger is associated with the gripper shaft. A disadvantage of this type of gripper is that the gripper finger must be associated with a soft gripper support and complicated adjustment must be made by means of two adjusting screws to ensure accurate operation. Furthermore, the gripping action becomes uncertain at high press speeds.

OBJECTS AND SUMMARY OF THE INVENTION

It is a primary object of the present invention to provide a sheet gripper of the kind hereinbefore set out wherein upon closure of the gripper finger, the finger is given a positive movement substantially perpendicular to the gripper support. It is a further object to provide such a gripper with increased retaining force.

This is accomplished, according to the present invention, by a gripper having a gripper shaft to which is secured a pivoting clamping member in resilient relationship with a pivotable gripper finger having a fulcrum and adjustable biasing, the finger being pivotally attached by a joint to a base member which is mounted loosely around the gripper shaft, the base member and gripper finger being adjustably pressed against the clamping member by a plurality of compression springs with associated stops, and the fulcrum being movable from the gripper shaft to the joint by means of a stop acting against the cylinder upon closure of the gripper finger.

The primary advantage of the invention is that the retaining process takes place separately from the gripping process, the former using a lever transmission to increase the force. Furthermore, the diameter of the spindle in the gripper finger pivot joint is very small so that the frictional loss there is negligible. Another advantage is that despite the fact that biasing is provided by two compression springs, the gripper retains its statically determined position even at high press speeds. In addition, there is no longer any need, as with conventional grippers, for the gripper shaft position to represent a compromise in that on the one hand it should be nearly level with the cylinder surface so as to occupy a favorable position with respect to gripper sliding, and on the other hand it should be nearly at a right-angle beneath the gripper tip so as to enable the front edge of the paper to move freely with a minimum pivot angle.

The construction of the gripper according to the invention enables both of the foregoing requirements to be optimized separately without either function suffering. One of the adjustable stops is situated in the paper plane so that there is no change of clearance in the pivot joint during the closing operation. Another adjustable stop is in the direction of the pull on the gripper base member and lies near the pivot joint so as to optimize the position of the pivot joint while minimizing the mass of each of the individual rotating elements.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
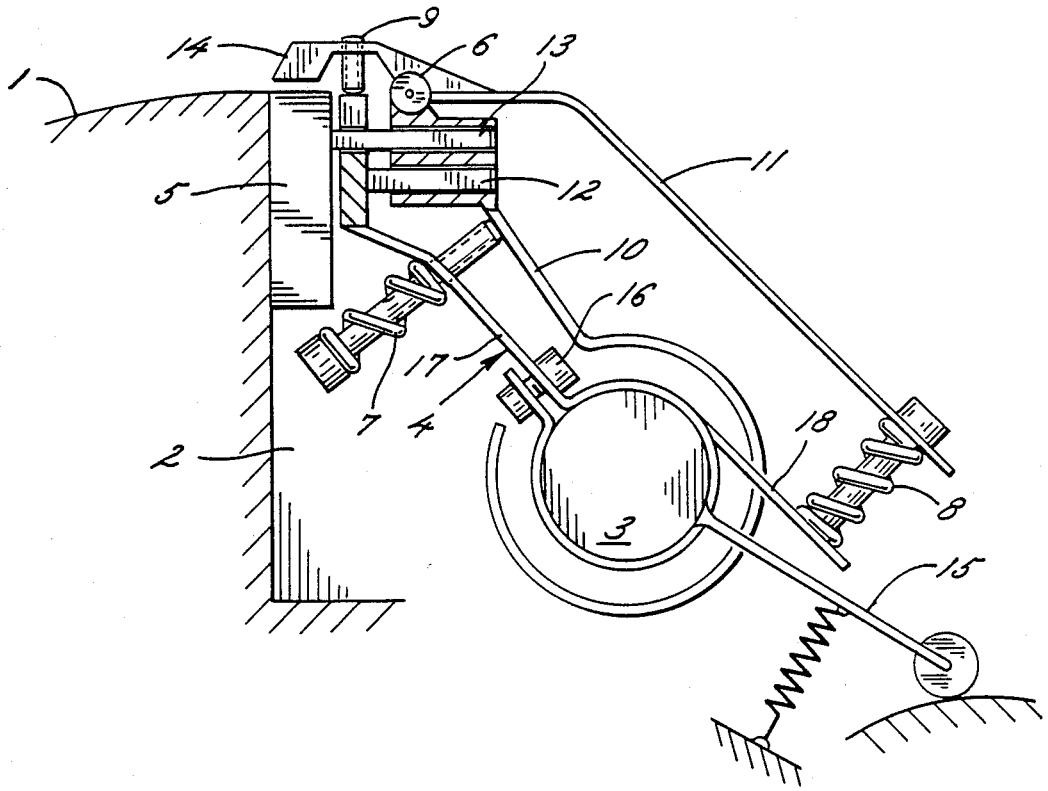
FIG. 1 diagrammatically illustrates a reslient gripper according to the present invention at the moment of the change of the fulcrum.
Figure 2:
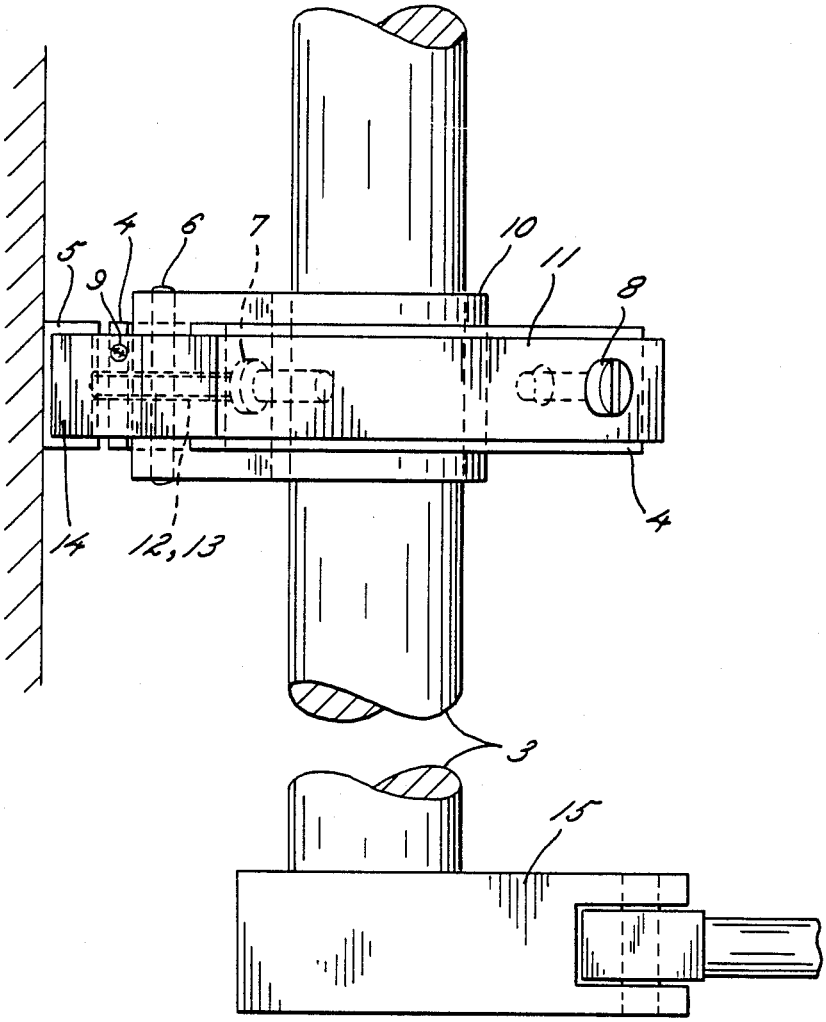
FIG. 2 is a plan view of the gripper of FIG. 1.

Turning now to the drawings, FIG. 1 shows a groove 2 formed in a cylinder 1 and a gripper shaft 3 with a stationary axis mounted in the groove 2. A clamping member 4 is clamped on the gripper shaft 3 preferably by a clamping screw 16. A gripper support 5, the surface of which is level with the circumferential surface of the cylinder 1, is secured to one wall of the groove 2. A gripper finger 11 is connected by a joint 6 to a base member 10 which is mounted loosely around the gripper shaft 3. Compression springs 7, 8 are disposed opposite one another with respect to the gripper shaft 3, the spring 7 being disposed between an arm 17 projecting from the clamping member 4 and a head of a pin affixed to the gripper base member 10 and extending through the arm 17 and the spring 8 being similarly disposed between the gripper finger 11 and another arm 18 projecting from the clamping member 4. The gripper finger 11 and the base member 10 are pressed against the clamping member 4 by way of the compression springs 7, 8 and adjustable stops 9, 12.

In practicing the invention, while closing the finger 11, the gripper shaft 3 including the clamping member 4 is moved by way of a gripper control 15 until the base member 10 bears by the stop 13 against a gripper bar 5 on the cylinder 1. At this point, the gripper is pivoted to a position above the sheet so that the gripper tip 14 is open about 2 mm (see FIG. 1). The gripper fulcrum then changes from the gripper shaft 3 to the joint 6 as the clamping member 4 continues to move via the gripper control 15 thereby pressing the gripper tip 14 onto the sheet by way of the spring 8 acting on an extended lever arm portion of the finger 11. The stop 9 by which the gripper finger 11 bears on the clamping member 4 is then free. According to the invention, an increase in retaining force is provided by the transmission ratio of the lengthened lever arm portion of the finger 11 in relation to the shorter lever arm of the pivotally supported finger tip 14.

From the foregoing, it will be appreciated that the separation of the gripping and retaining processes as provided according to the invention provides a multifunctional gripper control for the gripping process as well as the retaining process with just one cam for the gripper control system 15. The improved retaining effect due to a forceincreasing lever transmission in conjunction with non-slip substantially perpendicular gripper closure provides optimum gripping and retaining, yet it enables the front edge of the paper to be freely traversed with a minimum pivot angle during the gripping operation because it allows the gripper shaft 3 to be mounted low inside the cylinder 1 beneath the gripper tip 14. Furthermore, bearing play at the gripper shaft 3 and frictional forces which automatically increase considerably in other gripper arrangements due to increasing retention forces as well as inertia due to frictional losses all no longer have a considerable effect on the dynamic retention force of the gripper. Thus the operation of the gripper according to the invention does not become impaired even at very high press speeds. Additionally, despite the fact that biasing is provided by two compression springs 7, 8, the gripper finger 11 and base member 10 retain their statically determined positions even at very high press speeds since the gripping operation and the retaining operating are separated well before the centering of the gripper tip 14.

I claim as my invention:

1. A sheet gripping device mounted in the recess of a press cylinder of a sheet fed rotary printing press for engaging and pressing successive sheets against sheet support means on the cylinder comprising a gripper shaft mounted in said cylinder recess, a clamping member mounted on said gripper shaft for pivotal movement, a base member loosely mounted around said gripper shaft for permitting movement of said clamping member relative to said base member, a gripper finger, pivot means on said base member located radially outwardly of said gripper shaft from the rotational axis of said cylinder for supporting said gripper finger for pivotal movement relative to said base member, first biasing means for biasing said base member against said clamping member so that said clamping member, base member, and gripping finger are pivotable in unison between a retracted position in which said base member and gripper finger are disposed away from said sheet support means and a first position in which said base member and the gripper finger supported thereon are located in predetermined relation to said sheet support means, second biasing means interposed between said clamping member and gripper finger, means responsive to pivotal movement of said clamping member beyond said first position for permitting pivotal movement of said gripper finger about said base member pivot means by said second biasing means while said pivot means is disposed radially outwardly of said gripper shaft from the rotational axis of said cylinder for causing said gripper finger to engage and press a sheet against said sheet support means, one end of said gripper finger including a sheet engaging element, another end of said gripper finger, disposed on an opposite side of said pivot means from said sheet engaging element, being engaged by said second biasing means, and the distance from said pivot means to said sheet engaging element being smaller than the distance from said pivot means to the point where said second biasing means engages said gripper finger, whereby the sheet is securely gripped by said sheet engaging member due to a mechanical advantage of said gripper finger.

2. The sheet gripping device of claim 1 in which said first and second biasing means are disposed on opposite sides of said gripper shaft.

3. The sheet gripping device of claim 1 of which said second biasing means is a spring.

4. The sheet gripping device of claim 1 in which said base member has first stop means that is adjustable for positioning said base member in predetermined relation to said sheet support means upon movement of said base member to said first position.

5. The sheet gripping device of claim 4 in which said base member has second stop means that is adjustable for establishing a predetermined relative relation between said base member and clamping member during pivotal movement of said cover member, base member, and gripping finger between said retracted and first positions.

6. The sheet gripping device of claim 5 in which said gripping finger has an adjustable stop means that is engageable with said clamping member for establishing a predetermined position of said gripping finger relative to said clamping member during movement of said clamping member, base member, and gripping finger between said retracted and first positions.

* * * * *